US008791410B2

(12) United States Patent
Synal et al.

(10) Patent No.: US 8,791,410 B2
(45) Date of Patent: Jul. 29, 2014

(54) MASS SPECTROMETRY SYSTEM WITH MOLECULAR DISSOCIATION AND ASSOCIATED METHOD

(75) Inventors: Hans-Arno Synal, Steinmaur (CH); Tim Schulze-König, Heidelberg (DE); Martin Suter, Uster (CH)

(73) Assignee: Eth Zürich, Eth Transfer, Zürich (CH)

( * ) Notice: Subject to any disclaimer, the term of this patent is extended or adjusted under 35 U.S.C. 154(b) by 0 days.

(21) Appl. No.: 13/640,831

(22) PCT Filed: Apr. 7, 2011

(86) PCT No.: PCT/EP2011/001720

§ 371 (c)(1),
(2), (4) Date: Dec. 21, 2012

(87) PCT Pub. No.: WO2011/128040

PCT Pub. Date: Oct. 20, 2011

(65) Prior Publication Data

US 2013/0112869 A1 May 9, 2013

(30) Foreign Application Priority Data

Apr. 12, 2010 (EP) ..... 10003859

(51) Int. Cl.
*H01J 49/10* (2006.01)

(52) U.S. Cl.
USPC ..... 250/288; 250/281; 250/282; 250/423 R; 250/424

(58) Field of Classification Search
USPC ..... 250/423 R, 424, 281, 282, 288
See application file for complete search history.

(56) References Cited

U.S. PATENT DOCUMENTS

| | | | | |
|---|---|---|---|---|
| 3,611,029 | A * | 10/1971 | Stix | 361/230 |
| 4,037,100 | A | 7/1977 | Purser | |
| 5,661,299 | A | 8/1997 | Purser | |
| 6,815,666 | B2 | 11/2004 | Schroeder et al. | |
| 2006/0219897 | A1 * | 10/2006 | Schneider | 250/288 |

OTHER PUBLICATIONS

Schulze-Konig et al., "The dissociation of 13CH and 12CH2 molecules in He and N2 at beam energies of 80-250 keV and possible implications of radiocarbon mass spectrometry", Nuclear Instruments and Methods in Physics Research B 269(2011) pp. 34-39.*

(Continued)

*Primary Examiner* — Nicole Ippolito
(74) *Attorney, Agent, or Firm* — Browdy and Neimark, PLLC

(57) ABSTRACT

A mass spectrometry system based on the general principle of accelerator mass spectrometry (AMS) is disclosed. An ion source (10) generates a beam (B) of ions having a negative charge state. A first mass analyzer (20) transmits only ions having a predetermined mass. The ions are passed through a stripper target (80) comprising helium and/or hydrogen as a stripping gas to change the charge state of said ions from negative to positive charge and to dissociate molecular ions by collisions. A second mass analyzer (110, 130) transmits ions in charge state 1+ having the predetermined mass, which are detected by a detector (140). By using helium and/or hydrogen gas and detecting ions in charge state 1+, it becomes possible to use kinetic energies below 200 keV without excessive transmission losses due to angular straggling. At sufficiently low energies, no additional acceleration is required after ions have been extracted from the ion source. In alternative embodiments, no mass selection is carried out before charge exchange takes place.

27 Claims, 6 Drawing Sheets

(56) References Cited

OTHER PUBLICATIONS

Vockenhuber et al., "The potential of He stripping in heavy ion AMS", Nuclear Instruments and Methods in Physics Research B 294 (2013) pp. 382-386.*

M. Suter et al., "AMS of 14C at low energies", Nuclear Instruments and Methods in Physics Research B, vol. 123, pp. 148-152, 1997.

H.A. Synal et al., "New concepts for radiocarbon detection systems", Nuclear Instruments and Methods in Physics Research B, pp. 29-36, 2000.

H.A. Synal et al., "The PSI/ETH small radiocarbon dating system", Nuclear Instruments and Methods in Physics Research B, vol. 172, pp. 1-7, 2000.

H.A. Synal et al., "Radiocarbon AMS towards its low-energy limits", Nuclear Instruments and Methods in Physics Research B, pp. 339-345, 2004.

H.A. Synal et al., "MICADAS: A new compact radiocarbon AMS system", Nuclear Instruments and Methods in Physics Research Bm vol. 259, pp. 7-13, 2007.

Schulze-Konig, et al, "The dissociation of 13CH and 12CH2 molecules in He and N2 at beam energies of 80-250 keV and possible implications for radiocarbon mass spectrometry" Nuclear Instruments and Methods in Physics Research vol. 269, No. 1, pp. 34-391, Jan. 1, 2011.

* cited by examiner

MASS SPECTROMETRY SYSTEM WITH MOLECULAR DISSOCIATION AND ASSOCIATED METHOD

TECHNICAL FIELD

The present invention relates to a mass spectrometry system in which molecular ions are dissociated by gas collisions in a stripping gas, and to a corresponding method of mass spectrometry. Such mass spectrometry systems are generally used for the detection of rare nuclei against a strong background of molecular isobars, in particular, for the detection of long-lived radionuclides like $^{14}C$ in low abundance, possibly in natural abundance. Possible applications include $^{14}C$ dating and the detection of isotopic tracers in investigations of physical, chemical and biochemical processes.

PRIOR ART

The detection of rare nuclei by mass spectrometry requires the separation of mass ambiguities, which may arise from nuclear or molecular isobars of the nucleus of interest. In cases where the nuclear isobar comprises only nuclei that do not form stable negative ions, the nuclear isobar can be eliminated by using negatively charged ions. This is true, for example, if the nucleus of interest is $^{14}C$, whose only relevant nuclear isobar is $^{14}N$. The elimination of molecular isobars then remains a crucial problem to be solved.

Since the late 1970's a technique called accelerator mass spectrometry (AMS) has been developed to approach this problem. The key concept of AMS is based on the discovery that small molecules do not have any bound states if three or more electrons are stripped away, resulting in a charge state of at least 3+. In an AMS system, an ion source operating near ground potential generates a beam of negatively charged ions, which is passed through a first mass filter to select ions having a certain mass of interest. These ions are typically accelerated between ground potential and the positive high-voltage terminal of a tandem accelerator. The ions are then passed through a so-called stripper target at the high-voltage terminal, which may be a thin foil or preferably a gas canal filled with a stripping gas. By collisions with the stripper target, electrons are stripped from the ions, and a fraction of ions reach a charge state of at least 3+, whereby any molecules in the ion beam are dissociated. This results in an extremely effective rejection of any molecular background. The positively charged ions exiting the stripper target are subsequently further accelerated between the high-voltage terminal and ground and are subjected to a second mass filter, which selects ions having a charge state of 3+ and having the mass of interest. These ions are detected in a suitable gas or solid-state detector. This basic concept is described, e.g. in U.S. Pat. No. 4,037,100.

The stripping yield for a particular charge state is strongly dependent on the kinetic energy of the ions. For carbon ions at a charge state of 3+ and for the most commonly employed types of stripping gas, the highest yield is generally obtained at beam energies around 3 MeV, and consequently tandem accelerators having a high-voltage terminal at several megavolts (MV) are often employed to maximize yield.

Whereas such AMS methods provide high sensitivity, they require highly complex equipment due to the high voltages and high beam energies involved. This entails high operating costs and requires much laboratory space. It is therefore desirable to provide mass spectrometers of the AMS type which require less laboratory space and which may be manufactured and operated at lower costs.

In U.S. Pat. No. 5,661,299 it is suggested to accelerate the ions to comparatively low energies in the range of 150 keV to 300 keV, and to use helium as a stripping gas to obtain a charge state of at least 3+ in the ion beam. At these energies, the yield of carbon ions in charge states at or above 3+ is at least an order of magnitude lower than at a beam energy of 3 MeV. Nevertheless, the inventors of U.S. Pat. No. 5,661,299 apparently considered it to be mandatory to detect the carbon ions in a charge state of 3+, since it was commonly assumed at the time that only such a high charge state results in efficient dissociation of molecular ions. This results in a much lower sensitivity than for devices operating at higher voltages. For such a system, any further reduction in beam energy is prevented by a further sharp decrease in sensitivity resulting from an even further decreased yield of ions in charge state 3+.

More recently, it has been discovered that molecular ions interfering with the nuclide of interest can be destroyed efficiently by collisions with an argon or nitrogen stripping gas even if a charge state of only 2+ or even 1+ is reached. M. Suter, S. Jacob and H. A. Synal, "AMS of $^{14}C$ at low energies", Nucl. Instr. and Meth. B 123 (1997), 148-152 demonstrated that small hydrocarbon molecules (CH and $CH_2$) in charge state 1+ can be efficiently destroyed in an argon stripping gas at beam energies around 500 keV. The applicability of this concept to radiocarbon dating was demonstrated in H. A. Synal, S. Jacob and M. Suter, "New concepts for radiocarbon detection systems", Nucl. Instr. and Meth. B 161-163 (2000), 29-36, and in H. A. Synal, S. Jacob and M. Suter, "The PSI/ETH small radiocarbon dating system", Nucl. Instr. and Meth. B 172 (2000), 1-7.

Still lower beam energies were explored in H. A. Synal, M. Dobeli, S. Jacob, M. Stocker and M. Suter, "Radiocarbon AMS towards its low-energy limits", Nucl. Instr. and Meth. B 223-224 (2004), 339-345 and in H. A. Synal, M. Stocker and M. Suter, "MICADAS: A new compact radiocarbon AMS system", Nucl. Instr. and Meth. B 259 (2007), 7-13. A vacuum-insulated acceleration unit was used together with a commercially available 200 kV power supply in a tandem configuration. The lowest energy of ions entering the stripper target was about 220 keV. Either argon or nitrogen ($N_2$) was used as a stripping gas. The use of still lower beam energies was prevented by excessive transmission losses due to angular straggling.

U.S. Pat. No. 6,815,666 discloses a single-stage accelerator mass spectrometer which employs an air-insulated single-stage electrostatic accelerator instead of a tandem accelerator. The ion beam enters the stripper target at a beam energy of approximately 335 keV. $^{14}C$ nuclei in a charge state of 1+ are detected. Argon is used as a stripping gas. The ion source is located within the high-voltage electrode of the accelerator, at a potential difference of more than 300 kV to ground. This setup requires elaborate electrical insulation of the sample chamber and consequently renders sample changes time-consuming and complicated. In addition, this setup would suffer from the same problems, in particular, from much increased angular straggling, if the system would be operated at lower beam energies.

Therefore, in all these prior-art systems, a further reduction in size and complexity is hampered by the fact that a further reduction in beam energy would generally lead to a strong decrease in sensitivity.

SUMMARY OF THE INVENTION

According to a first aspect, it is an object of the present invention to provide a mass spectrometry system which enables an efficient destruction of molecular ions while requiring less space and lower cost.

According to a second aspect, it is an object of the invention to provide a corresponding method of mass spectroscopic analysis.

According to the first aspect, the present invention provides a mass spectrometry system having the following features:

- an ion source configured to generate a beam of ions having a negative charge state;
- a first mass analyzer configured to receive ions generated in said ion source and to transmit ions having a mass-to-charge ratio corresponding to a first predetermined mass and a charge state of 1−;
- a stripper target configured to receive ions that have been transmitted by said first mass analyzer, the stripper target comprising a stripping gas to change the charge state of said ions from negative to positive charge and to dissociate molecular ions by collisions with said stripping gas;
- a second mass analyzer configured to receive ions that have exited the stripper target and to transmit ions having a mass-to-charge ratio corresponding to a second predetermined mass and a charge state of 1+; and
- a detector configured to detect ions in a charge state of 1+ that been transmitted by the second mass analyzer.

According to the second aspect, a method of mass spectrometry is provided, comprising:

- operating an ion source to form a beam of ions having a negative charge state;
- subjecting the beam to a first mass analyzer transmitting ions having a mass-to-charge ratio corresponding to a first predetermined mass and a charge state of 1−;
- injecting the ions that have been transmitted by the first mass analyzer into a stripper target comprising a stripping gas to change the charge state of ions from negative to positive charge and to dissociate molecular isobars among said ions;
- subjecting the ions exiting the stripper target to a second mass analyzer transmitting ions having a mass-to-charge ratio corresponding to a second predetermined mass and a charge state of 1+; and
- detecting ions in charge state 1+ that have been transmitted by the second mass analyzer.

According to the present invention, in both aspects of the invention the stripping gas comprises at least one gas selected from helium (He) and hydrogen ($H_2$ or $D_2$) gas, and the system is configured to inject the ions into the stripper target at a kinetic energy below 200 keV, preferably below 150 keV or even below 100 keV.

The inventors of the present invention have discovered that the cross section for the destruction of light molecular ions in charge state 1+ in light gases like helium is only slightly dependent on the kinetic energy of the ions and is sufficiently large below 200 keV or even below 100 keV that a substantially complete destruction of interfering molecular ions can be achieved with a comparatively small target thickness of the stripper target. At the same time, a comparatively large yield of ions in charge state 1+ is obtained, while annular straggling is considerably reduced by the use of such light gases as compared to heavier stripping gases like argon or nitrogen. Due to reduced angular straggling, a high transmission may be achieved even at moderate angular acceptance angles of the ion optical components.

The large cross section for molecular dissociation in a charge state of only 1+ at low kinetic energies is completely unexpected. In fact, there has been a strong prejudice in the art that sufficient suppression of molecular ions would be impossible with light gases like helium or hydrogen as a stripping gas if a charge state of only 1+ is utilized, let alone at kinetic energies as low as those suggested by the present invention.

Due to the low required kinetic energy of the ion beam, construction of the presently proposed mass spectrometry system is much simplified, resulting in lower investment and lower operating costs, and less floor space is required.

The stripping gas may be pure helium, pure hydrogen, a mixture of these two gases, or a mixture of one or both of these gases with different gases. Preferably the stripping gas comprises at least 50%, more preferably at least 80% of helium and/or hydrogen. Preferably it consists essentially of at least one gas selected from helium and hydrogen. In a preferred embodiment, the stripping gas essentially consists of helium. In this context, the term "consisting essentially of" is to be understood in the usual manner as meaning that any other constituents are present only in amounts that do not materially change the characteristics of the stripping gas.

The stripper target may comprise the stripping gas in essentially static form, i.e., the bulk gas flow velocity is much smaller than the mean (rms) thermal velocity of the gas atoms or molecules. In particular, the stripping gas may form a comparatively slow stream of gas in a differentially pumped stripper channel. Alternatively, the stripper target may be a rapid jet of stripping gas, the direction of the jet preferably being transverse to the beam direction. Both types of targets are as such well known in the art.

The second predetermined mass is preferably identical to the first predetermined mass, but may also be chosen to be different from the first predetermined mass, depending on the actual application; e.g. the first mass may be selected to correspond to the mass of a certain molecule of interest to be dissociated in the stripper target, whereas the second mass may correspond to the mass of a single nucleus in that molecule. In particular, the second predetermined mass may be different from the first predetermined mass by one or two atomic mass units (amu). In a preferred embodiment, both the first and second preselected mass are 14 amu so as to selectively detect $^{14}C$ ions; the molecular ion isobars to be dissociated in the stripper target then include $^{12}CH_2$, $^{13}CH$ and $^{7}Li_2$. However, the system may also be used to detect other nuclei for which nuclear isobars can be separated already at the ion source, e.g., $^{26}Al$ or $^{129}I$, whose nuclear isobars $^{26}Mg$ and $^{129}Xe$ do not form stable negative ions, or to detect nuclei whose nuclear isobars are not relevant and for which only molecular interferences are of concern, as in certain trace element studies.

In preferred embodiments, the ions are only accelerated by the ion source, and no additional acceleration is employed after the ions have been extracted from the ion source (in particular, preferably no acceleration is employed between the first mass analyzer and the stripper target). In particular, the tandem accelerator that is normally used in AMS systems may be dispensed with completely. In such embodiments, the stripper target may be kept at or near ground potential, which further simplifies construction considerably. The term "ground potential" in this context refers to the potential level of those components of the system that are commonly accessible by an operator. By the way of example, in many embodiments, the first and/or second mass analyzers will be at ground potential.

In other embodiments, the mass spectrometry system may still employ some moderate acceleration after extraction of the beam from the ion source. In particular, the system may be configured to keep the stripper target at an elevated electrostatic potential relative to ground, the potential difference between the stripper target and ground being generally less than 200 kV (preferably less than 150 kV or even less than 100 kV). In particular, the present invention still encompasses the use of a tandem accelerator to accelerate the ions entering the stripper target to the desired kinetic energy, while the first and second mass analyzers are kept at or close to ground potential.

Alternatively, the present invention also encompasses the use of a single-stage accelerator, e.g. similar to the accelerator disclosed in U.S. Pat. No. 6,815,666. However, in such embodiments it is preferred if the ions are accelerated by the single-stage accelerator before the ions pass the first mass analyzer, without further acceleration between the first mass analyzer and the stripper channel. In particular, an ion source that is immediately followed by a single-stage accelerator accelerating the ion beam to a final energy of less than 200 keV, preferably less than 150 keV or even less than 100 keV, may be considered to be equivalent to an ion source having an elevated extraction energy and shall be considered to be encompassed by the concept of employing no additional acceleration after extraction.

In order to achieve sufficient background suppression, the stripping gas in the stripper target preferably has a gas area density (i.e. volume density integrated over the length of the stripper target) of at least 0.1 $\mu g/cm^2$ (micrograms per square centimeter), in particular at least 0.25 $\mu g/cm^2$. Measurements indicate in such a range of values it is possible to achieve a suppression of light molecular ions by more than nine orders of magnitude relative to the total ion current. On the other hand, the stripping gas area density should not be too high in order to prevent excessive angular straggling. Preferably, the stripping gas area density is less than approximately 2.5 $\mu g/cm^2$, in particular, less than 0.75 $\mu g/cm^2$. These numbers are in particular applicable if the stripping gas essentially consists of helium, but will be similar for hydrogen. The two quantities contributing to gas area density (i.e., gas pressure in the stripper target and the length of the stripper target) will strongly depend on the design of the stripper target. In the case of essentially static stripper targets, typical lengths of the stripper target are in the range from about 10 cm to about 50 cm.

Both the first mass analyzer and the second mass analyzer act as mass filters, transmitting ions only in a certain range of the dimensionless mass-to-charge ratio m/z. The resolution of the mass analyzers should be high enough to clearly distinguish between ions having a difference in their m/z ratio of one. Preferably one or both of these mass analyzers is a sector-type mass analyzer. Many types of sector arrangements and geometries are known in the art. In particular, the first mass analyzer preferably is a sector (dipole) magnet. The second mass analyzer preferably comprises a sector magnet followed by an electrostatic deflector. However, other types of mass analyzers as they are well known in the art may be used as the first and second mass analyzer, including Wien filters, purely electrostatic analyzers, quadrupole analyzers etc. The mass analyzers may or may not be complemented by additional ion optical elements, like quadrupole lenses etc.

At least one Faraday cup may be provided to capture ions rejected by the mass analyzers, to measure a current of such ions. In particular, at least one Faraday cup may be placed in the focal plane of the first mass analyzer, and at least one further Faraday cup may be placed in the focal plane of the second mass analyzer.

In order to provide the stripper target with a controlled flow of the stripping gas, the system may comprise a source of that gas and a gas supply system configured to supply the stripping gas to the stripper target, as well as a pump system for removing and possibly recycling the stripping gas from a housing in which the stripper target is arranged.

In alternative embodiments, the ion beam may be passed through the stripping gas already before any mass analysis takes place. In other words, the invention also relates to a mass spectrometry system comprising:

an ion source configured to generate a beam of ions having a negative charge state;

a stripper target configured to receive ions generated by said ion source, the stripper target comprising a stripping gas to change the charge state of said ions from negative to positive charge and to dissociate molecular ions by collisions with said stripping gas;

a mass analyzer configured to receive ions that have exited the stripper target and to transmit ions having a mass-to-charge ratio corresponding to a predetermined mass and a charge state of 1+; and a detector configured to detect ions that have been transmitted by the mass analyzer, wherein the stripping gas comprises at least one gas selected from helium and hydrogen gas and wherein the system is configured to inject said ions into said stripper target at a kinetic energy below 200 keV.

A corresponding method comprises the following steps:

operating an ion source to form a beam of ions having a negative charge state;

injecting the ions into a stripper target comprising a stripping gas to change the charge state of ions from negative to positive charge and to dissociate molecular ions by collisions with said stripping gas;

subjecting the ions exiting the stripper target to a mass analyzer transmitting ions having a mass-to-charge ratio corresponding to a predetermined mass and a charge state of 1+; and detecting ions that have been transmitted by the mass analyzer, wherein the stripping gas comprises at least one gas selected from helium and hydrogen gas and wherein the ions are injected into said stripper target at a kinetic energy below 200 keV.

To achieve sufficient selectivity in such embodiments, the ions exiting the stripper target are preferably subjected to at least two separate mass filtering steps, wherein in each mass filtering step ions not having said predetermined mass-over-charge ratio are rejected. To this end, the mass analyzer preferably comprises at least two mass filters arranged in series, each mass filter being configured to reject ions not having the predetermined mass-over-charge ratio.

Similar considerations as for the embodiments with mass selection before the stripper target apply also for the embodiments without mass selection before the stripper target. In particular, the system is preferably configured to keep the stripper target at an electrostatic potential difference relative to ground potential of zero or less than 200 kV. Preferably no substantial acceleration of the ions takes place any more after the ions exit the stripper target. The same consideration for the choice, density and flow of the stripper gas as above also apply here.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
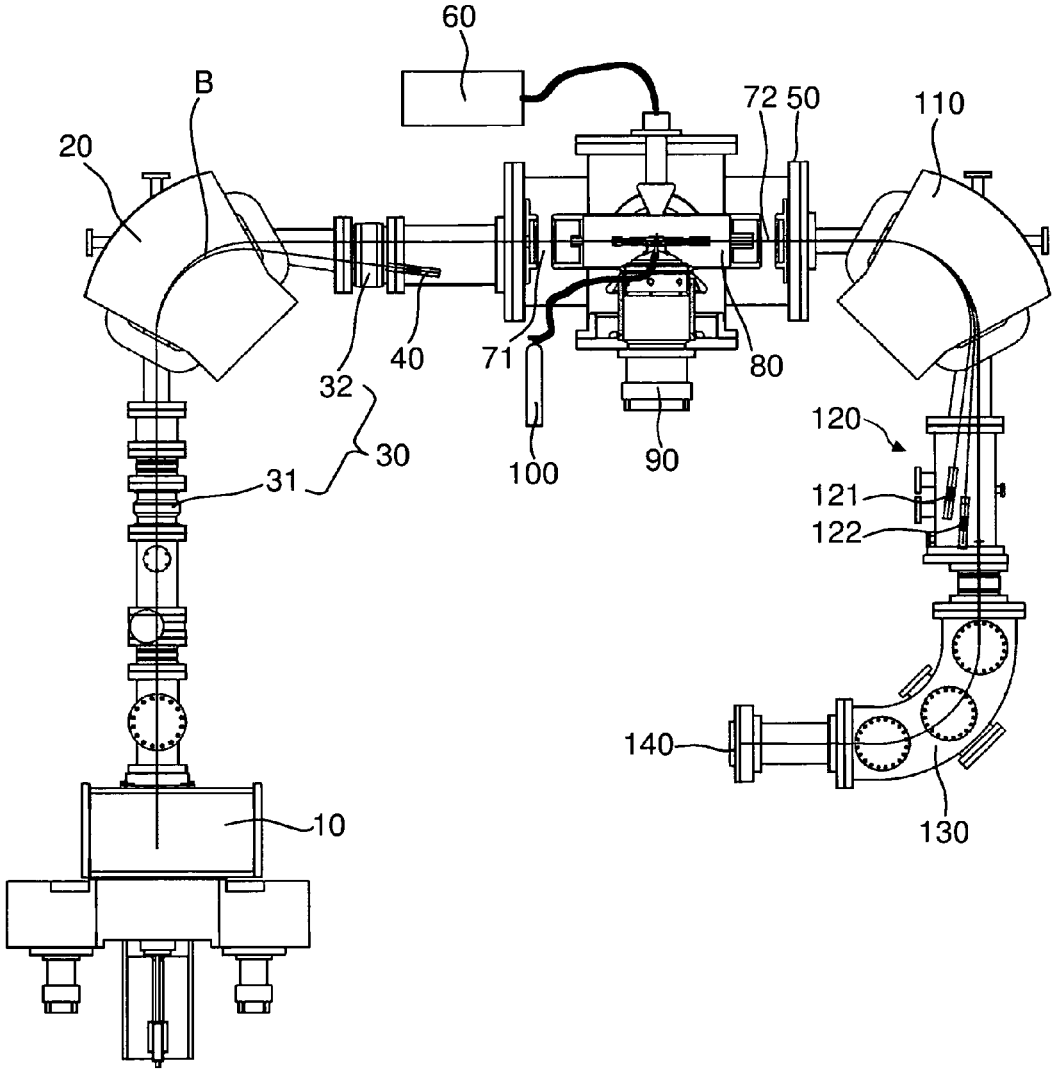
FIG. 1 shows a mass spectrometry system according to a first embodiment.

FIG. 1 illustrates a prototype setup of a compact mass spectrometry system according to a first embodiment of the invention. This prototype is generally very similar to the system described in H. A. Synal, M. Stocker and M. Suter, "MICADAS: A new compact radiocarbon AMS system", Nucl. Instr. and Meth. B 259 (2007), 7-13. This document will in the following be referenced as the "MICADAS paper", and explicit reference is made to this document for teaching the general setup and operation of a mass spectrometry system of the type illustrated here. The only notable difference to that document is the use of a much lighter stripping gas than nitrogen.

An ion source 10 in the form of a Cs sputter ion source generates an ion beam B having an energy up to 40 keV. A first mass analyzer 20 in the form of a 90° dipole sector magnet (bending radius 25 cm) receives the ion beam extracted from the ion source 10. At the focal points before and after the magnet, variable slit apertures are installed. At the magnet image plane, a first Faraday cup 40 is positioned off-axis from the beam axis, for measuring an ion current of selected ions rejected by the first mass analyzer 20 (in the case of radiocarbon application, this will generally be the $^{12}C$ current). A fast beam switching system 30 comprising beam switching units 31 and 32 enables the pulsed injection of the beam into the subsequent accelerator 50. The accelerator comprises a high-voltage platform inside a vacuum chamber. Two acceleration gaps 71 and 72 acting as gap lenses maintain the voltage gradient between the high-voltage platform and ground potential at the entry and exit flanges of the accelerator in a tandem configuration. The high voltage is provided by a commercially available high-voltage power supply 60, providing voltages of up to 200 kV. At the high-voltage platform, a stripper target in the form of a windowless stripping gas cell 80 is located inside a differentially pumped housing, acting as a molecule dissociator. Up to three turbo-molecular vacuum pumps 90 mounted at ground potential are used to remove the stripping gas. Gas is fed to the stripping gas cell 80 from a stripping gas source 100 with an associated gas supply system for the controlled feeding of the stripping gas to the gas cell. Ions emerging from the accelerator 50 are analyzed in an achromatic mass analyzer comprising a stigmatic 90° sector magnet 110 (bending radius 25 cm), followed by an electrostatic deflector 130 having a bending radius of 25 cm and a gap of 3.6 cm. Together with the sector magnet, it provides non-energy dispersive beam transport. A beam monitoring system 120 comprising second Faraday cups 121 and 121 is positioned in the focal plane of the sector magnet off-axis from the beam axis, for measuring ion currents of selected ions rejected by the second mass analyzer. In the case of radiocarbon applications, these Faraday cups may be used for measuring $^{12}C$ and $^{13}C$ currents. Finally, a detector 140 in the form of a gas ionization chamber serves for energy-resolved detection of ions that have been transmitted by the second mass analyzer.

This prototype setup requires a floor space of only approximately 2.5 m×2.5 m. A further reduction in floor space will be possible by optimization of the individual components and their connections.

Figure 2:
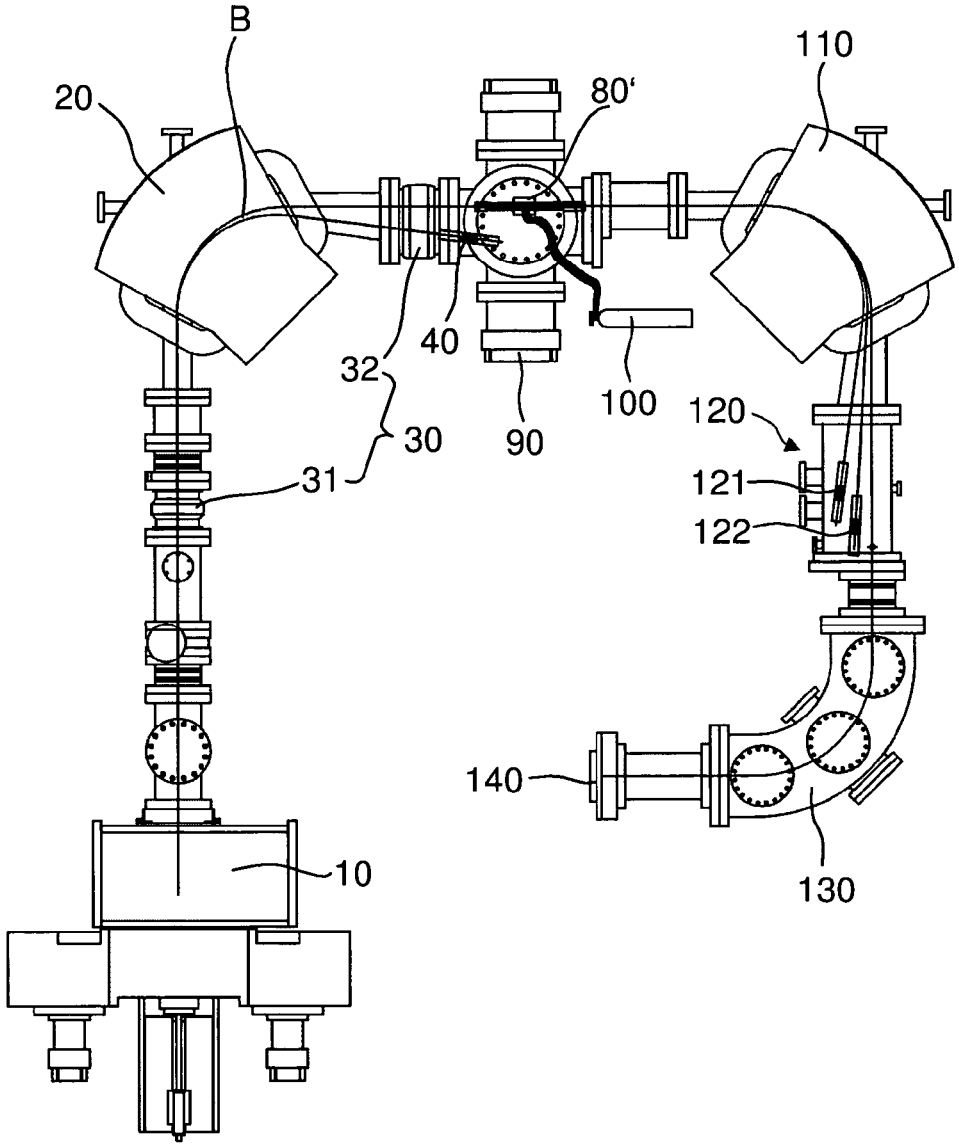
FIG. 2 shows a mass spectrometry system according to a second embodiment.

A second embodiment of a compact mass spectrometry system according to the present invention is illustrated in FIG. 2. Like components of the system carry the same reference numbers as in FIG. 1 and will not be described again. The key difference to the first embodiment is the absence of an accelerator. The stripping gas cell 80' in this embodiment is simply located at ground potential within a differentially pumped housing. The required floor space is thus reduced to only approximately 2.5 m×2 m. Since the beam energy before and after the stripper target is almost the same, the first and second mass analyzers may be dimensioned similarly and operated at similar operating conditions. Due to the low beam energies involved, smaller components may be used for the second mass analyzer than in the first embodiment.

Figure 3:
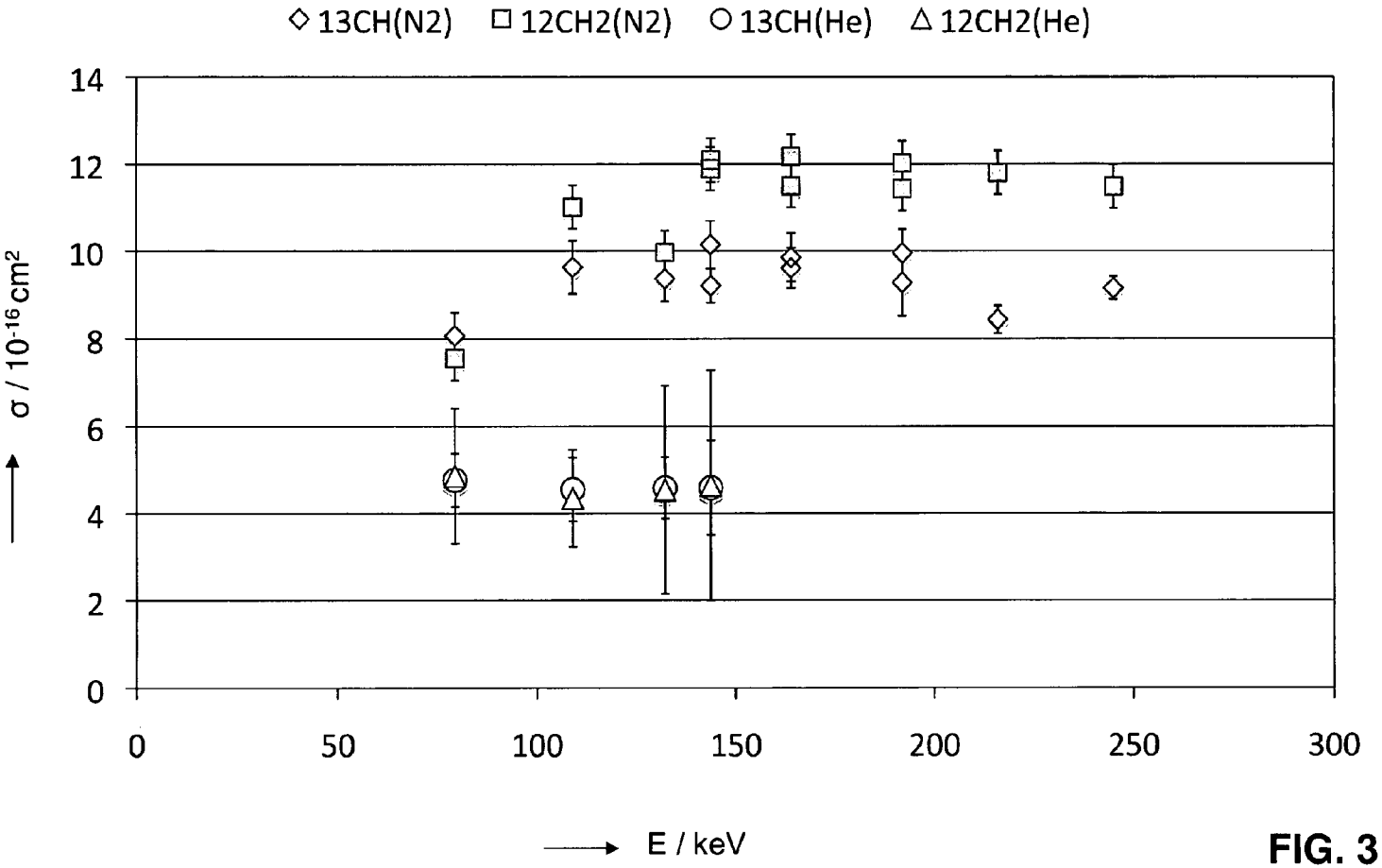
FIG. 3 shows a diagram illustrating measured cross sections for molecular dissociation as a function of kinetic energy.

FIG. 3 shows measurements of the dissociation cross sections of $^{12}CH_2$ and $^{13}CH$ molecules in $N_2$ and He gas, for a final charge state of 1+. These measurements were carried out with the general setup of the MICADAS paper, at variable beam energies. Cross sections $\sigma$ in $N_2$ reach between 8 and $12\times10^{-16}$ cm$^2$ at ion energies E above 150 keV. These cross sections strongly decrease at beam energies below 100 keV. Cross sections in He are somewhat smaller at all energies, but appear to be largely independent of energy at least in the range between 70 and 150 keV. Both the weak energy dependence and the relatively high absolute value of the cross sections in helium are unexpected. The fact that the cross section in helium is comparatively large even at low energies forms one key element of the present invention. Similar results may be expected if the stripping gas is hydrogen or a mixture of helium and hydrogen.

Figure 4:
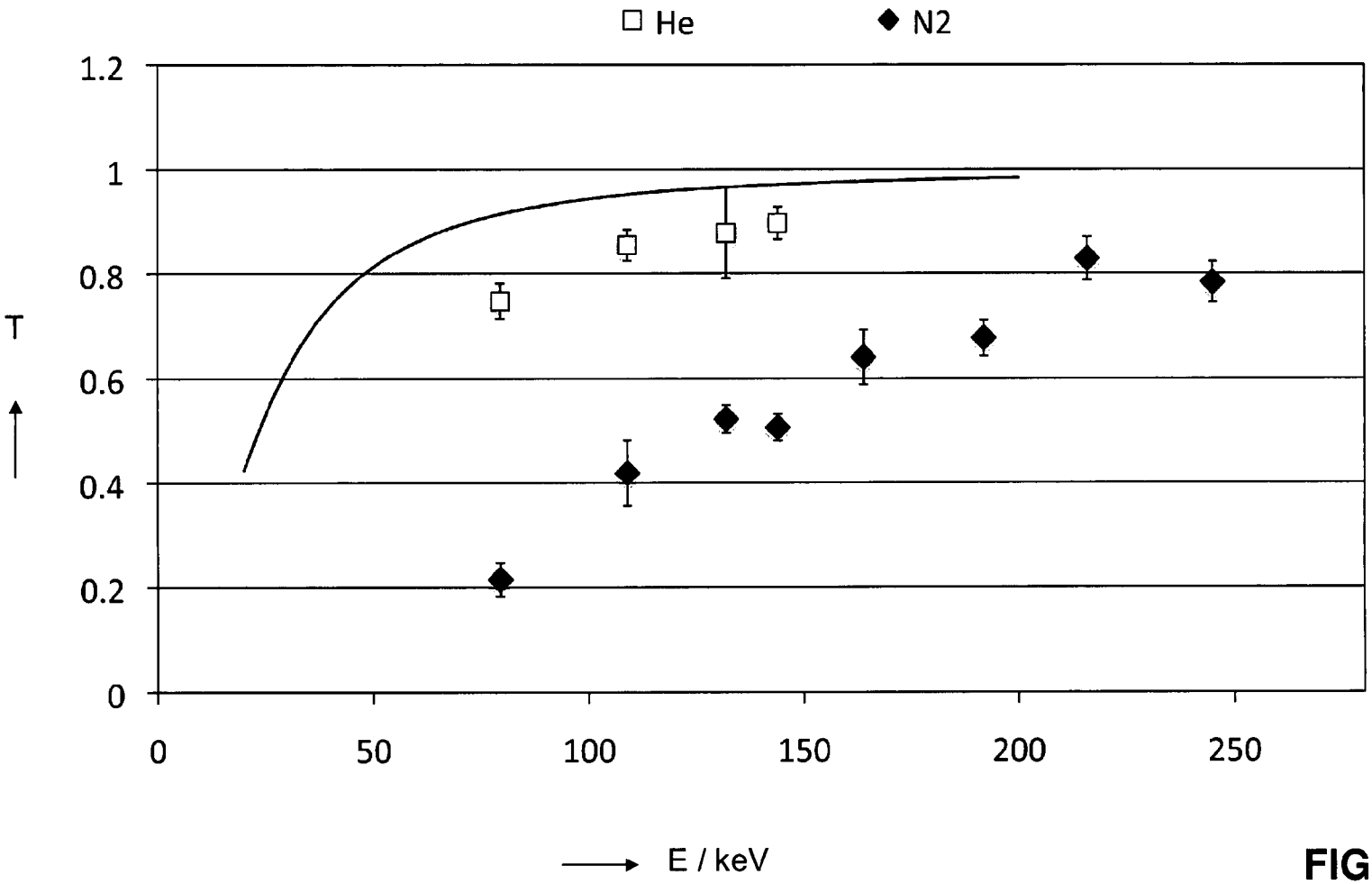
FIG. 4 shows a diagram illustrating ion optical transmission of $^{12}C$ ions through a molecule dissociator.

Another key element is the fact that angular straggling in such light gases is much reduced as compared to heavier stripping gases like argon or nitrogen. This is illustrated in FIG. 4, which shows measurements of ion optical transmission T for $^{12}C^{1+}$ ions as a function of ion energy E, for helium and nitrogen as stripping gases. These measurements were again carried out with the general setup of the MICADAS paper. At energies below 200 keV, the transmission decreases strongly if nitrogen is used as a stripping gas. A value below 25% transmission was measured at an ion energy of 70 keV. In contrast, transmission was still well above 70% when helium was used as a stripping gas. The solid line in FIG. 4 corresponds to model calculations carried out for He as a stripping gas at an area density of 0.5 μg/cm$^2$ for a half angle of acceptance of 32 mrad of the ion optical system. These model calculations are in fair agreement with the experimental data and show that ion optical transmission is expected to be fairly high for beam energies down to 50 keV or less, still reaching 80% at 50 keV. Beam energies in the range of 50 keV can readily be obtained by simply extracting ions from a suitable ion source, with little or no subsequent additional acceleration.

Figure 5:
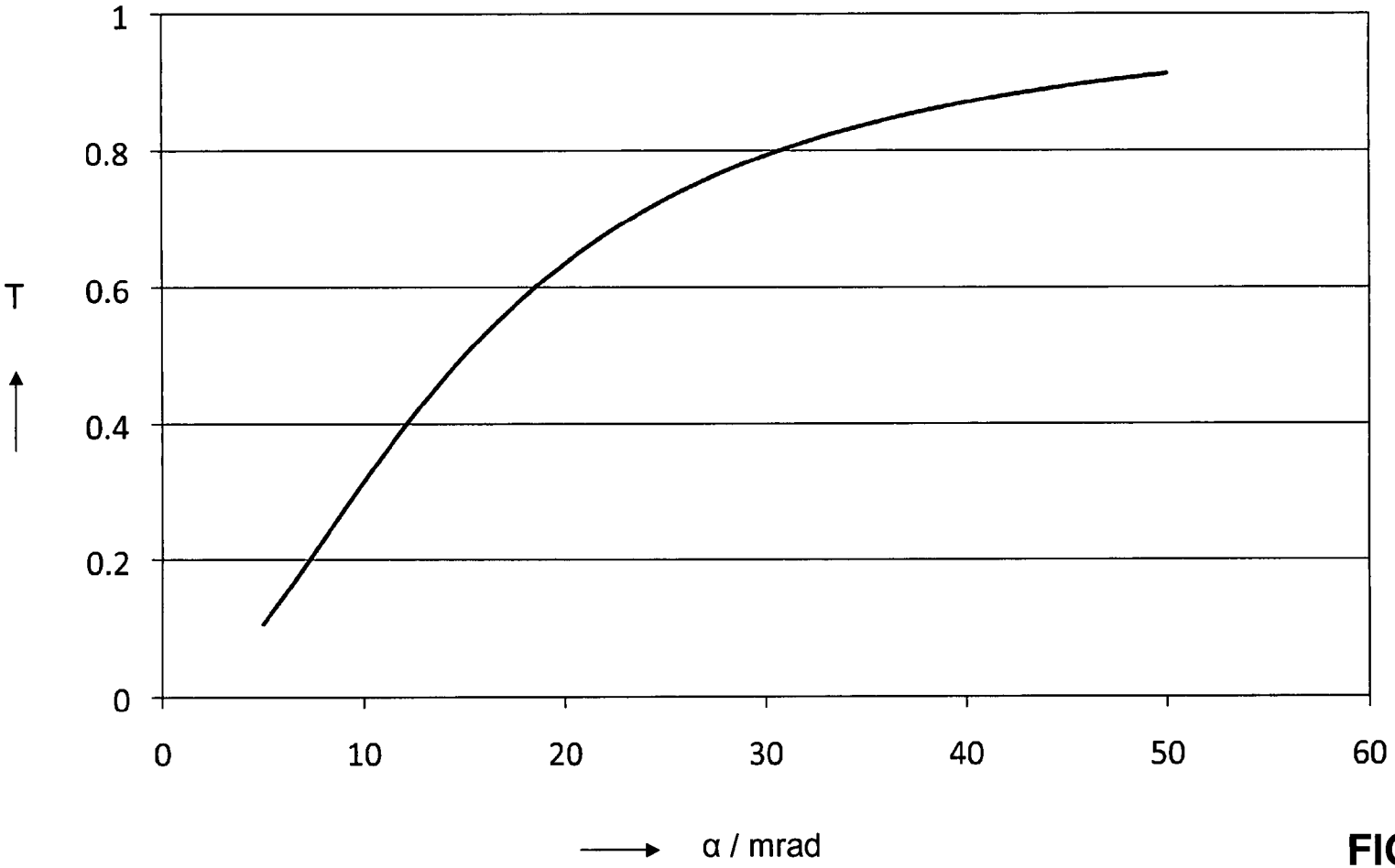
FIG. 5 shows a diagram illustrating the calculated ion optical transmission of $^{12}C$ through a molecule dissociator as a function of the angle of acceptance.

This picture is complemented by FIG. 5, which shows the calculated ion transmission T of the stripper target (molecule dissociator) as a function of the half angle of acceptance a for $^{12}C^{1+}$ tons at an energy of 50 keV for a gas area density of 0.5 μg/cm$^2$. A transmission of more than 80% is predicted if the half angle of acceptance is at least 32 mrad. This is a value which can readily be realized with currently available ion optical systems. A much higher angle of acceptance would be required for heavier stripping gases like nitrogen or argon.

A third key element of the present invention is the relatively large charge equilibrium fraction (i.e. the fraction of ions having a selected charge state after having passed through the stripping gas at an area density that is sufficient to reach equilibrium among the charge states) of ions in charge state 1+ in the energy range below 200 keV when helium or other light gases are used as a stripping gas. Measurements of charge equilibrium distributions of light ions in helium are disclosed in P. Hvelplund, E. Laesgaard and E. Horsdal Pedersen, "Equilibrium charge distributions of light ions in helium, measured with a position-sensitive open electron multiplier", Nucl. Instr. and Meth. 101 (1972), 497-502. These measurements show that a charge equilibrium fraction for charge state 1+ of more than 50% is expected for carbon ions at an energy of 100 keV in helium gas, whereas the fraction for charge state 3+ will be exceedingly small.

Altogether, these three elements enable the construction of a highly sensitive mass spectrometry system in which the molecular background is very efficiently suppressed despite a low beam energy and despite the fact that the ions of interest are detected in charge state 1+.

It is to be understood that various modifications are possible without departing from the scope of the present invention, and that the scope of the present invention is not intended to be limited to the above preferred embodiments. In particular, instead of using an accelerator in a tandem configuration, a single-stage accelerator may be employed. In such embodiments, it will be preferred if the single-stage accelerator is arranged between the ion source and the first mass analyzer, so as to further accelerate the ion beam to the desired energy before any mass analysis takes place. In this manner, symmetry between the first and second mass analyzers may be preserved, and the mass analyzers may both be operated at ground potential. Conceptually, such an arrangement may be considered to be equivalent to having an ion source with elevated extraction energy (an ion source "boosted" by the single-stage accelerator associated therewith).

Figure 6:
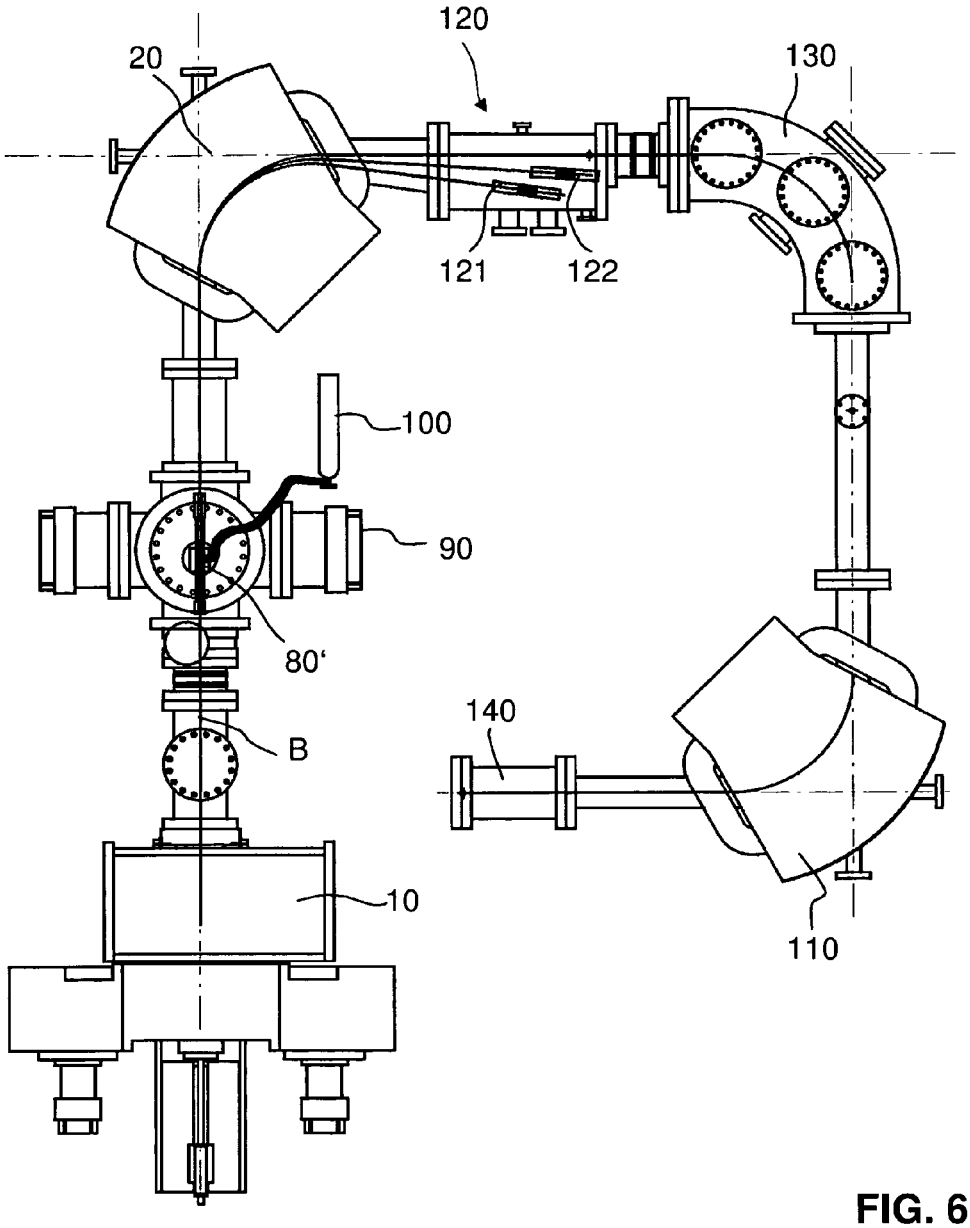
FIG. 6 shows a mass spectrometry system according to a third embodiment.

In the first and second embodiment it is possible that small amounts of stripping gas might leak into the regions upstream of the stripping gas cell. In particular, in the first embodiment, some stripping gas might leak into the acceleration gap 71 at the entrance side of the stripping gas cell. In both the first and second embodiments, some stripping gas might even leak into the region of the first mass analyzer 20. This leaking may cause charge exchange of some of the ions in the ion beam while the ions are still being deflected or accelerated. By this premature charge exchange, nuclei and molecules not having the desired mass-to-charge ratio might be able to enter the stripping gas cell and might even be able to pass the second mass analyzer. These problems are avoided by a third embodiment of a compact mass spectrometry system according to the present invention, which is illustrated in FIG. 6. Like components of the system carry the same reference numbers as in FIGS. 1 and 2 and will not be described again. The key difference to the first and second embodiment is that no mass selection is carried out before charge exchange in the stripper target takes place. The full negative ion beam B exiting the ion source 10 enters the stripping gas cell 80', which in the present example is constructed in the same manner as in the second embodiment. In the stripping gas cell 80', the charge state of the ions is changed from negative to positive, and molecular ions are efficiently dissociated. The ions exiting the stripping gas cell 80' are then subjected to a first mass filtering step in a first dipole sector magnet 20, without any additional acceleration after the stripping gas cell. The ions are received by a focal plane beam monitoring system 120 similar to the one described in conjunction with the first embodiment, and ions rejected by the first mass filter are collected in off-axis Faraday cups 121, 122. Ions transmitted by the first mass filter are subjected to an achromatic second mass filter consisting of an electrostatic deflector 130 and a second dipole sector magnet 110 to improve selectivity. The ions transmitted by the second mass filter are then detected by a detector 140 as in the first and second embodiments.

Of course also this embodiment may be modified in several ways. In particular, it is possible to employ some moderate additional acceleration between the ion source 10 and the stripping gas cell 80' and optionally also between the stripping gas cell 80' and the first dipole sector magnet 20. The sequence of mass filters may be chosen to be different to the presently proposed sequence, e.g., instead of a sequence comprising a first magnet, an electrostatic analyzer followed by a second magnet, the electrostatic analyzer might alternatively be employed after the second magnet. It is also possible to use other types of mass filters altogether.

Possible applications of the system include radiocarbon dating as well as tracer studies in which $^{14}C$ labels are attached to a molecule of interest and its chemical pathway in some (possibly very complex) chemical reaction or its biochemical pathway in e.g. metabolic processes is followed. However, while the system described above has been developed in the context of $^{14}C$ detection, the system may readily be adapted for the detection of other types of ions.

LIST OF REFERENCE SIGNS

| | | | |
|---|---|---|---|
| 10 | ion source | 110 | sector magnet |
| 20 | sector magnet | 120 | beam monitoring system |
| 30 | beam switching system | 121, 122 | Faraday cup |
| 40 | Faraday cup | 130 | electrostatic deflector |
| 50 | accelerator | 140 | detector |
| 60 | high voltage supply | B | beam |
| 71, 72 | acceleration gap | E | energy |
| 80, 80' | gas cell | σ | cross section |
| 90 | vacuum pump | T | transmission |
| 100 | stripping gas source | α | half angle of acceptance |

The invention claimed is:

1. A mass spectrometry system comprising:

an ion source configured to generate a beam of ions having a negative charge state;

a first mass analyzer configured to receive ions generated in said ion source and to transmit only ions having a mass-to-charge ratio corresponding to a first predetermined mass and a charge state of 1−;

a stripper target configured to receive ions that have been transmitted by said first mass analyzer, the stripper target comprising a stripping gas to change the charge state of said ions from negative to positive charge and to dissociate molecular ions by collisions with said stripping gas, said stripping gas comprising at least one gas selected from helium and hydrogen gas;

a second mass analyzer configured to receive ions that have exited the stripper target and to transmit ions having a mass-to-charge ratio corresponding to a second predetermined mass and a charge state of 1+; and a detector configured to detect ions in a charge state of 1+ that have been transmitted by the second mass analyzer, wherein the system is configured to inject said ions into said stripper target at a kinetic energy below 200 keV.

2. The mass spectrometry system of claim 1, wherein the system is configured to keep the stripper target at an electrostatic potential difference relative to the first mass analyzer of zero or less than 200 kV.

3. The mass spectrometry system of claim 1, wherein the system is configured to keep the stripper target at an electrostatic potential difference relative to ground potential of zero or less than 200 kV.

4. The mass spectrometry system of claim 1, wherein said stripping gas comprises at least 50 atomic percent of at least one gas selected from helium or hydrogen gas.

5. The mass spectrometry system of claim 1, wherein said stripping gas essentially consists of helium.

6. The mass spectrometry system of claim 1, wherein said stripper target is essentially static.

7. The mass spectrometry system of claim 1, wherein said stripper target is a jet of said stripping gas.

8. The mass spectrometry system of claim 1, wherein the stripping gas in the stripper target has a gas area density of at least 0.1 $\mu g/cm^2$.

9. The mass spectrometry system of claim 1, further comprising a source of said stripping gas and a gas supply system configured to supply the stripping gas to said stripper target.

10. The mass spectrometry system of claim 1, wherein the first and second predetermined masses are 14 amu.

11. A mass spectrometry system comprising:

an ion source configured to generate a beam of ions having a negative charge state;

a stripper target configured to receive ions generated by said ion source, the stripper target comprising a stripping gas to change the charge state of said ions from negative to positive charge and to dissociate molecular ions by collisions with said stripping gas, said stripping gas comprising at least one gas selected from helium and hydrogen gas;

a mass analyzer configured to receive ions that have exited the stripper target and to transmit ions having a predetermined mass-to-charge ratio corresponding to a predetermined mass and a charge state of 1+; and a detector configured to detect ions that have been transmitted by the mass analyzer, wherein the system is configured to inject said ions into said stripper target at a kinetic energy below 200 keV.

12. The mass spectrometry system of claim 11, wherein the mass analyzer comprises at least two mass filters arranged in series, each mass filter configured to reject ions not having said predetermined mass-over-charge ratio.

13. The mass spectrometry system of claim 11, wherein the predetermined mass is 14 amu.

14. The mass spectrometry system of claim 11, wherein the system is configured to keep the stripper target at an electrostatic potential difference relative to ground potential of zero or less than 200 kV.

15. The mass spectrometry system of claim 11, wherein said stripping gas comprises at least 50 atomic percent of at least one gas selected from helium or hydrogen gas.

16. The mass spectrometry system of claim 11, wherein said stripping gas essentially consists of helium.

17. The mass spectrometry system of claim 11, wherein the stripping gas in the stripper target has a gas area density of at least 0.1 $\mu g/cm^2$.

18. A method of mass spectrometry comprising:

operating an ion source to form a beam of ions having a negative charge state;

subjecting the beam to a first mass analyzer transmitting ions having a mass-to-charge ratio corresponding to a first predetermined mass and a charge state of 1−;

injecting the ions that have been transmitted by the first mass analyzer into a stripper target comprising a stripping gas to change the charge state of ions from negative to positive charge and to dissociate molecular isobars among said ions, said stripping gas comprising at least one gas selected from helium and hydrogen gas, wherein the ions are injected into said stripper target at a kinetic energy below 200 keV;

subjecting the ions exiting the stripper target to a second mass analyzer transmitting ions having a mass-to-charge ratio corresponding to a second predetermined mass and a charge state of 1+; and detecting ions in charge state 1+ that have been transmitted by the second mass analyzer.

19. The method of claim 18, wherein the second predetermined mass is identical to the first predetermined mass.

20. The method of claim 19, wherein the first and second predetermined masses are 14 amu.

21. The method of claim 18, wherein the ions are accelerated between the first mass analyzer and the stripper target by a potential difference of zero or of less than 200 kV.

22. The method of claim 12, further comprising:

capturing ions that have been rejected by said first or second mass analyzer, and measuring a current of said captured ions.

23. The method of claim 18, wherein the stripping gas in the stripper target has a gas area density of at least 0.1 $\mu g/cm^2$.

24. A method of mass spectrometry comprising:

operating an ion source to form a beam of ions having a negative charge state;

injecting the ions into a stripper target comprising a stripping gas to change the charge state of ions from negative to positive charge and to dissociate molecular ions by collisions with said stripping gas, said stripping gas comprising at least one gas selected from helium and hydrogen gas, wherein the ions are injected into said stripper target at a kinetic energy below 200 keV;

subjecting the ions exiting the stripper target to a mass analyzer transmitting ions having a mass-to-charge ratio corresponding to a predetermined mass and a charge state of 1+; and detecting ions that have been transmitted by the mass analyzer.

25. The method of claim 24, wherein the ions, after entering said mass analyzer, are subjected to at least two separate mass filtering steps, wherein in each mass filtering step ions not having said predetermined mass-over-charge ratio are rejected.

26. The method of claim 24, wherein the stripping gas in the stripper target has a gas area density of at least 0.1 $\mu g/cm^2$.

27. The method of claim 24, wherein the predetermined mass is 14 amu.

* * * * *